US005669504A

United States Patent [19]

Leone et al.

[11] Patent Number: 5,669,504

[45] Date of Patent: Sep. 23, 1997

[54] THERMOPLASTIC BAG CLOSURE

[75] Inventors: Richard E. Leone, Newark; William J. Randolph, Palmyra, both of N.Y.

[73] Assignee: Tenneco Plastics Company, Evanston, Ill.

[21] Appl. No.: 504,880

[22] Filed: Jul. 20, 1995

[51] Int. Cl.[6] ..... B65D 33/14; B65D 33/18

[52] U.S. Cl. ..... 206/554; 383/211; 383/99

[58] Field of Search ..... 383/211, 210, 383/42, 78, 81, 98, 99; 206/554

[56] References Cited

U.S. PATENT DOCUMENTS

| | | | |
|---|---|---|---|
| 3,125,281 | 3/1964 | Woolen | 383/99 X |
| 4,578,814 | 3/1986 | Skamser | 383/99 |
| 4,581,007 | 4/1986 | Kamp | 493/264 |
| 4,796,759 | 1/1989 | Schisler | 206/54 |
| 5,020,750 | 6/1991 | Vrooman et al. | 248/97 |

*Primary Examiner*—Jacob K. Ackun
*Attorney, Agent, or Firm*—Arnold, White & Durkee

[57] ABSTRACT

The invention relates to a bag closure for a thermoplastic grocery bag. Integral closure tabs are formed in the bag front and rear walls at the bag mouth. After the bag has been loaded, the front wall closure tab is pulled across the bag open mouth towards the rear of the bag. The rear wall closure tab is then pulled in the opposite direction across the bag mouth towards the front of the bag to engage an adhesive zone positioned on the exterior surface of the front wall. The adhesive zone is made up of a low tack, high-shear adhesive and is positioned just below the bag mouth. The adhesive zone resists shear forces generated while the bag is closed but releases easily when the rear closure tab is pulled in a direction normal to the bag wall.

12 Claims, 6 Drawing Sheets

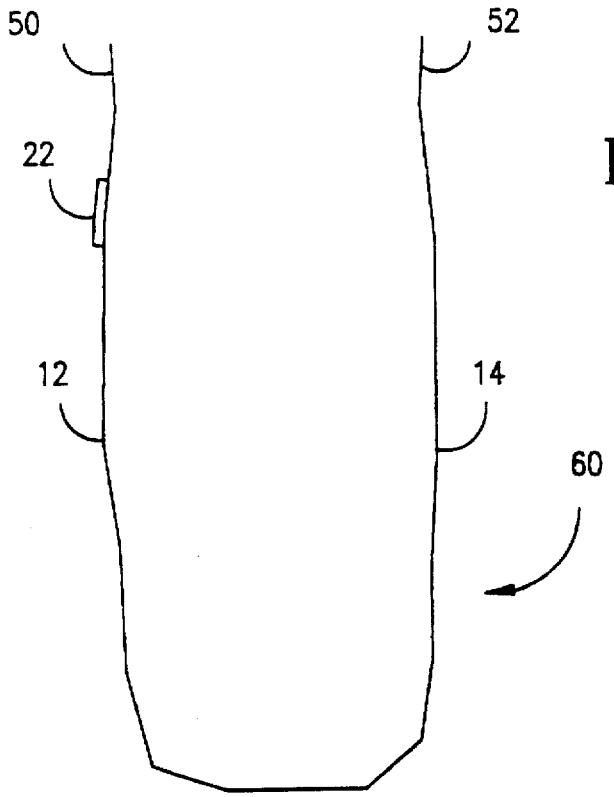
FIG. 5
FIG. 6
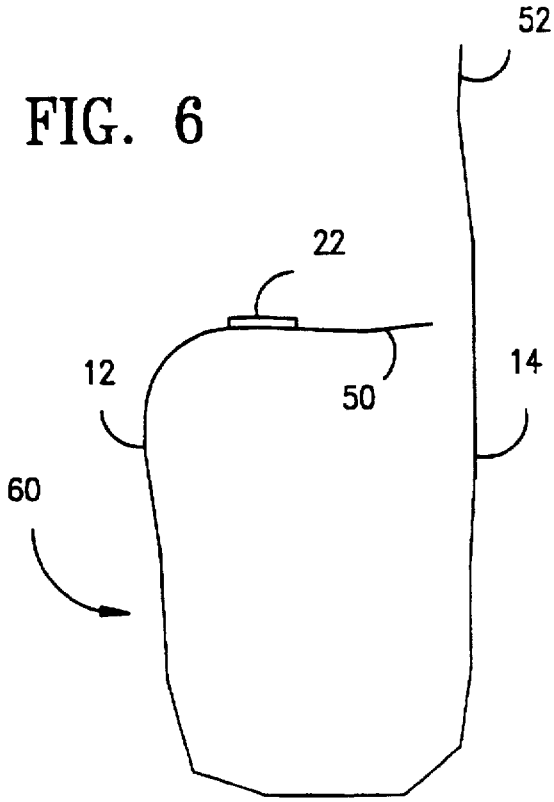
FIG. 7
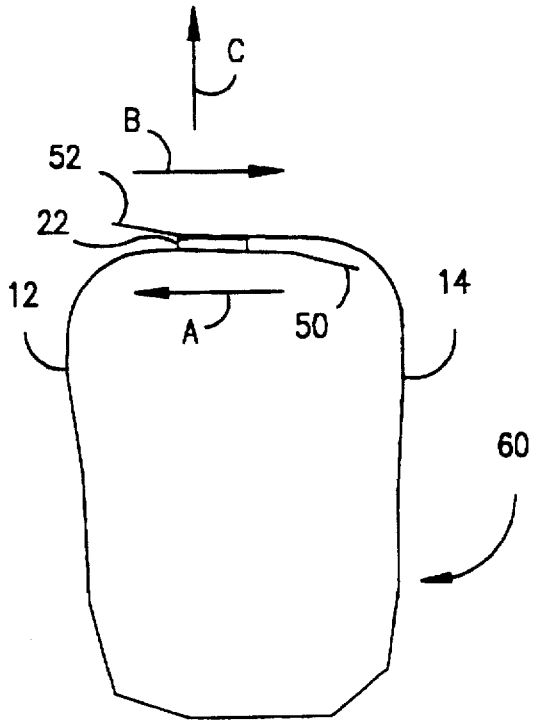

THERMOPLASTIC BAG CLOSURE

FIELD OF THE INVENTION

This invention relates to thermoplastic film bags, such as undershirt type grocery bags or the like. In particular, it provides an adhesive bag closure for such a bag.

BACKGROUND OF THE INVENTION

Plastic bags are steadily gaining acceptance where consumer goods of all types must be bundled up for transport away from the point of sale. These bags are used in many different types of retail settings to include grocery stores, department stores of all types, building supply stores and any other setting where a lightweight, strong, easy to dispense bag, is required. The advantages of plastic bags over kraft paper bags are numerous. They are lighter in weight, take up less room when folded, resist water, and may be fabricated with integral handles that provide for easy transport of the loaded bag. They are reusable as trash can liners or can be reused to carry other items. Thermoplastic bags are also recyclable.

However, a problem encountered with the use of these bags arises from their lack of inherent rigidity and lack of a convenient closure means. In the grocery bag application it is not unusual for a fully loaded bag to be placed on a consumer's vehicle seat just before leaving with the purchase. As the vehicle turns, the bags typically fall over spilling their contents. The consumer is then faced with the time-consuming and inconvenient task of packing the bag a second time before it can be removed from the vehicle. It would be advantageous to provide a thermoplastic bag with a quick, easy to use bag closure that would close off the bag mouth after loading yet be easy to open at a later time for unloading. A further advantage would be realized if the closure could be opened without destroying the relatively thin material from which thermoplastic bags are constructed.

The use of adhesives in a bag closure are known in the art. U.S. Pat. No. 4,581,007 to Kamp discloses an adhesive bag having a Z-folded closure flap extending from the rear wall of the bag. After the bag has been filled, the closure flap can be pulled over the mouth of the bag and secured to the front wall of the bag using an adhesive contained within the Z-fold. The adhesive is protected from contact with air and other exterior objects by its location on the inside of the flap.

In U.S. Pat. No. 4,796,759 to Schisler there is provided a hole in each handle of the bags of a bag pack. A center support tab extends from the mouth of each bag and the tabs are joined together by welding or gluing to secure the bags in a pack. A line of perforations separate the support tab from the bag mouth. Below the perforation of each line of each bag is a "glued or welded localized zones 9" which insures connection between the rear wall of one bag and the front wall of any next bag. Above this point 9, the welded-together support tabs maintain the bags in registration and the localized glued or welded zones 9 assist in opening the bags during the dispensing and loading of the same. The bag provides no means for a bag closure.

The use of an adhesive to open a bag is also disclosed in U.S. Pat. No. 5,020,750 to Vrooman et al which is directed to a system for providing automatic consecutive opening and dispensing thermoplastic grocery or retail T-shirt bags. The system includes a bag pack and a rack. Each of the bags in the bag pack has a disengageable adhesive means which connects the rear wall of a leading bag to the front wall of a following bag. The patent discloses that the adhesive should have a peel strength of approximately 0.23 lbs. and a shear strength of approximately 2.5 lbs. As a leading bag in the bag pack is removed from the rack the adhesive connection between bags serves to pull open the following bag in the bag pack.

It is also possible to use the bag of the present invention in a bag dispensing system utilizing a pack of unitized bags. U.S. Pat. Nos. 5,183,158 to Boyd et al. and 4,989,732 to Smith, the contents of which are incorporated herein by reference in their entirety, describe a pack of unitized bags which are releasably connected such that when one bag is pulled from the dispensing rack after loading, the next bag in the pack is pulled open.

These and other advantages and features of the invention will be readily apparent to one of ordinary skill in the art upon an examination of the specification and drawings herein.

SUMMARY OF THE INVENTION

The present invention overcomes the disadvantages of the prior art bag closures by providing a simple, convenient closure that can be economically implemented. The need for a separate tie or closure element with all the attendant ramifications (cost, need to inventory, complexity) is eliminated by the use of closure that is integral to the bag itself. The ability to color code the adhesive zone of the present invention is a tremendous benefit to check out personnel in a grocery store setting where even a few seconds saved on each transaction can create impressive savings.

In order to achieve the objects of the invention, as embodied and broadly described herein, this invention relates to a pack of thermoplastic bags the bags being in at least approximate registration each bag comprising: (a) a front wall having an exterior surface; (b) an adhesion zone located on the exterior surface of the front wall; (c) a rear wall having an exterior surface, wherein at least a portion of the rear wall exterior surface is free of corona discharge treatment, the portion being in substantial alignment with the adhesion zone of a following bag in the pack; (d) gusseted side walls connecting the front and rear walls; (e) an open bag mouth defined by the front wall, rear wall and side walls; and (f) a first closure integral with the front wall and positioned at the bag open mouth and a second closure integral with the rear wall and positioned at the bag open mouth, whereby the first closure and the second closure are adapted to close the open bag mouth by the engagement of the second closure with the adhesive zone.

The present invention also relates to a bag closure for a thermoplastic grocery bag having front and rear walls with exterior surfaces and gusseted side walls which walls define a bag mouth comprising: at least one front closure tab extending upwardly from the front wall at the bag mouth; at least one rear closure tab extending upwardly from the rear wall at the bag mouth; and at least one adhesion zone positioned on the exterior surface of the front wall adjacent the bag mouth; whereby the front closure tab and the rear closure tab are adapted to substantially close the bag mouth when the front closure tab is pulled across the bag mouth towards the rear of the bag, and the rear closure tab is pulled across the bag mouth towards the front of the bag to engage the adhesive zone.

It is an object of this invention to provide an adhesive closure for a thermoplastic bag using integral closure means in cooperation with an adhesive zone.

Another object of the present invention is to provide a thermoplastic bag having an easily located, color tinted adhesive zone.

Still another object of the present invention is to provide a bag closure that does not require a separate tie or securing means.

It is an additional object of the present invention to provide a thermoplastic bag closure that can be easily reopened without destroying the bag itself.

It is to be understood that both the foregoing general description and the following detailed description are exemplary and explanatory only and are not restrictive of the invention as claimed.

The accompanying drawings, which are incorporated in and constitute a part of the specification, illustrate one embodiment of the invention and, together with the description, serve to explain the principles of the invention.

BRIEF DESCRIPTION OF THE DRAWINGS

FIGS. 5 through 7 are section views of the bag taken through the closure means to illustrate the cooperative relationship therebetween.

DETAILED DESCRIPTION OF THE INVENTION

Reference will now be made in detail to a present-preferred embodiment of the invention, an example of which is illustrated in the accompanying drawings.

Figure 1:
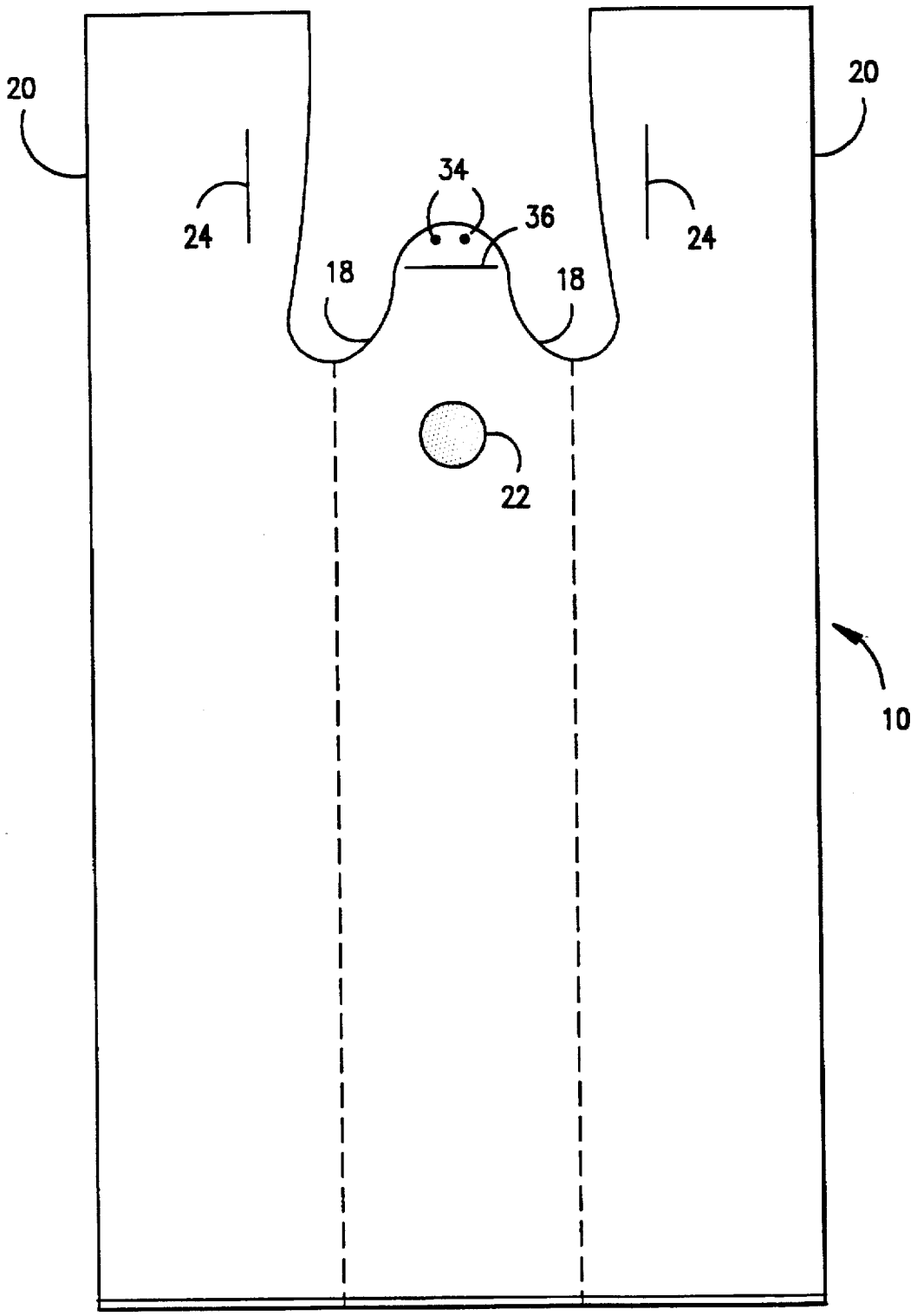
FIG. 1 is an elevation view of a single bag in the bag pack of the present invention.

The present invention relates to a pack of thermoplastic bags with the bags therein being in at least approximate registration. Turning now to FIG. 1, there is shown an elevation view of a single bag 10 making up the bag pack of the present invention. The bag 10 includes a front wall 12, a rear wall 14 with the two walls connected by gusseted side walls 16. (See FIG. 2). An open bag mouth 18 is defined by the walls with the mouth located between double film loop handles 20 extending upwardly from either side of the open bag mouth. The bag may further include orifices 24 in the handles for suspending the bag pack from a bag rack for easy dispensing.

On the exterior surface of the front wall 12 there is provided at least one adhesion zone 22. The adhesion zone 22 overlays at least a portion of the exterior surface of the front wall of the bag and is preferably comprised of a low tack-high shear adhesive as will be described in more detail herein below. The adhesion zone 22 is desirably of sufficient size to hold closed a fully loaded thermoplastic bag in a secure fashion. Although a circular shape is shown in FIG. 1, the shape of the zone may vary greatly. The zone could be either rectangular, square or some other shape so long as it is of sufficient size to perform its intended function. In a particularly preferred embodiment the zone is a circle having a diameter of about 9.5 mm (⅜ in). The adhesion zone is desirably positioned just below the bag mouth.

Figure 3:
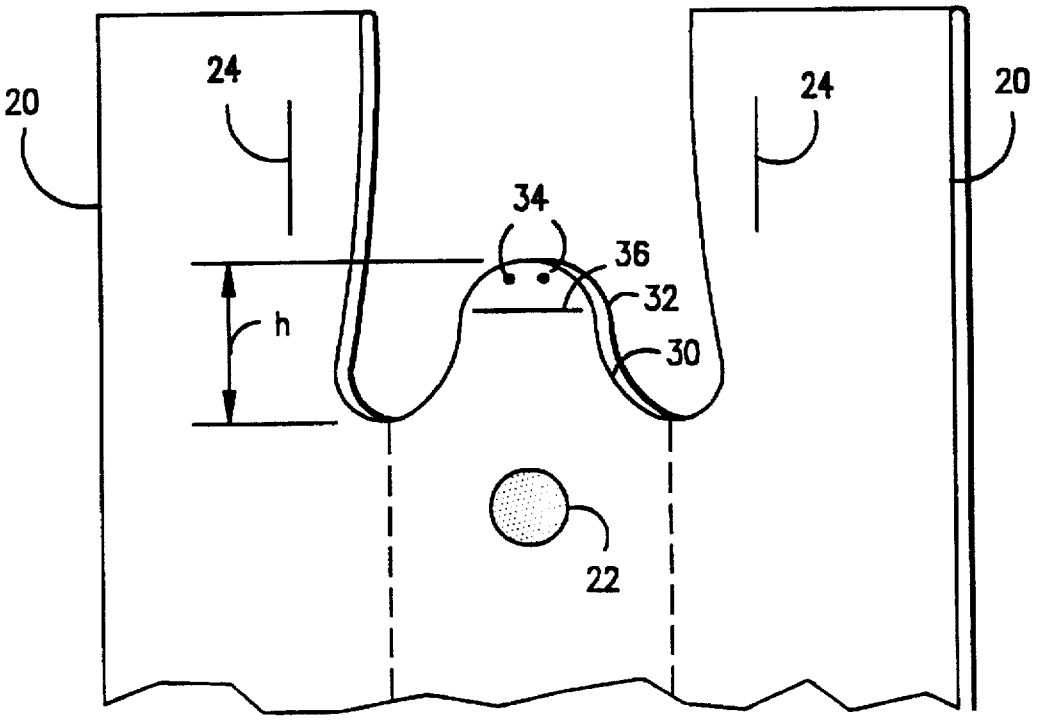
FIG. 3 is a partial elevation view of the top of a single bag in the bag pack of the present invention.

Turning now to FIG. 3, a partial front elevation of the bag, it can be seen that a first closure 30 extends upwardly from the front wall at the bag mouth. There is a corresponding second closure 32 extending upwardly from the rear wall at the bag mouth. Each of the closures is an integral extension of the associated bag wall. It can be seen that the adhesion zone 22 is centered from side to side on the exterior surface of the bag front wall. The adhesion zone 22 is preferably positioned in substantial side to side alignment with the closure means. The adhesion zone is preferably located adjacent to the front closure tab just below the bag mouth 18 at a distance of about 3.81 cm (1.5 in). This distance may vary based on how secure a closure is desired. As the adhesion zone is moved down the front wall 12 a more secure closure is obtained. Another factor affecting the position of the adhesion zone 22 is the closure height shown as dimension "h" in FIG. 3. As this height is varied the position of the adhesion zone 22 may also need to be varied to maintain acceptable performance of the bag closure. In a preferred embodiment this height is about 5.08 cm (2 in) with a width of about 5.08 cm (2 in).

Figure 2:
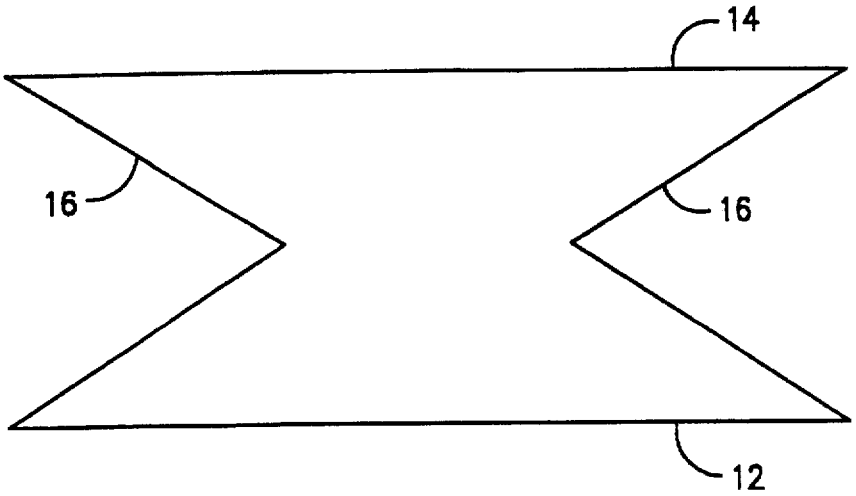
FIG. 2 is a cross-section view of the bag.

In a bag pack, the closures are desirably fused together at least one point to assist in holding the bags in registration. The preferred embodiment in FIG. 1 and in more detail in FIG. 2 shows the closures fused together at points 34. Any well known method in the art may be adapted for fusing together the closures. The closures are further characterized by a separable cut 36 located adjacent to and just below the fusing point or points. The separable cut 36 also functions as an orifice to permit the fused closing means to be secured to a bag dispensing rack. The fusing points and the slit are preferably located towards the upper end of the closures so as to maximize the closure height available to close the bag. A preferred location for this separable cut 36 is about 1.3 cm (½ in) below the top of each closure. The separable cut is desirably about 4.6 cm (1.8 in) wide.

Though the closures shown in FIG. 2 have a rounded shape, the practice of the present invention includes using a variety of shapes for this element. For example, a square top closure could be used. It is also within the scope of the present invention to utilize at least one additional closure in each bag wall. Corresponding adhesive zones would also be provided for each additional closure. This alternative embodiment may be used for large bags having an extended dimension between bag handles.

Figure 4:
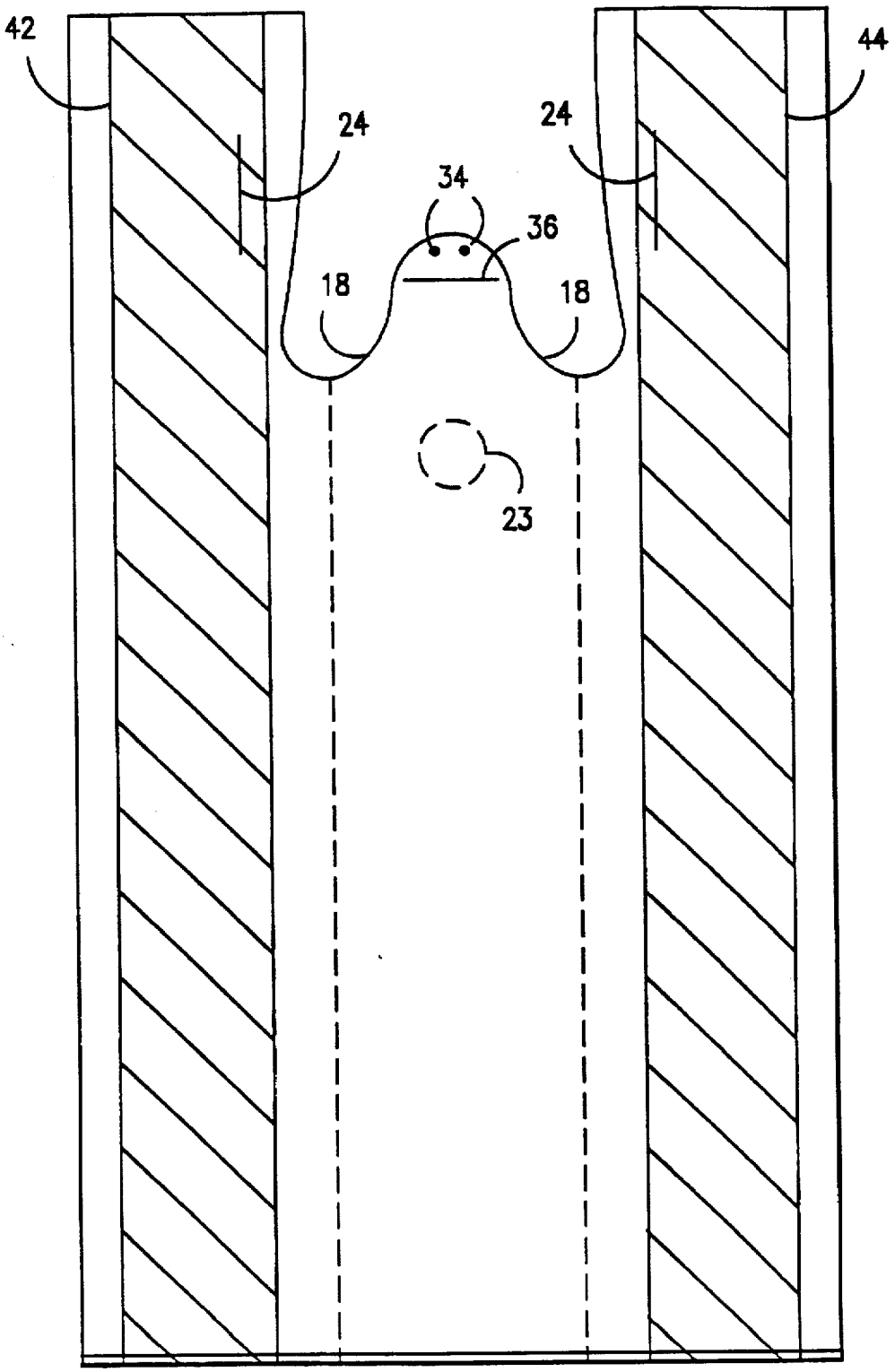
FIG. 4 is an elevation view of a single bag in the bag pack of the present invention.

It is common practice and well known in this art to corona discharge treat the exterior surfaces of thermoplastic bag material to facilitate the printing of advertising graphics, application of substrates or the like thereon. It is also well known that such items do not readily adhere to untreated areas. Accordingly, the bag structure of the present invention contemplates that at least a portion of the exterior surface of the rear wall of each bag in the pack be left free of corona treatment. FIG. 4 shows an elevation of the bag rear wall with treated areas indicated by shaded areas 42 and 44. The untreated portion is disposed between the treated areas and is in substantial alignment with the adhesion zone of a following bag in the bag pack. A following bag adhesion zone 23 is shown in dotted line. The untreated portion serves to minimize the adhesive contact between the adhesive material on the front wall of a following bag with the rear wall of a leading bag. Such adhesive contact would cause the bags in the pack to stick together and be very difficult to separate. Moreover, loss of adhesive material to an adjoining bag degrades the performance of the adhesive closure. It is highly desirable to minimize and ideally to eliminate altogether the transfer of adhesive between bags. It is not an objective of this invention to create an adhesive connection between bags in the bag pack. Moreover, it should be recognized that the treatment pattern illustrated in FIG. 4 is but one of many possible alternatives.

Figure 10:
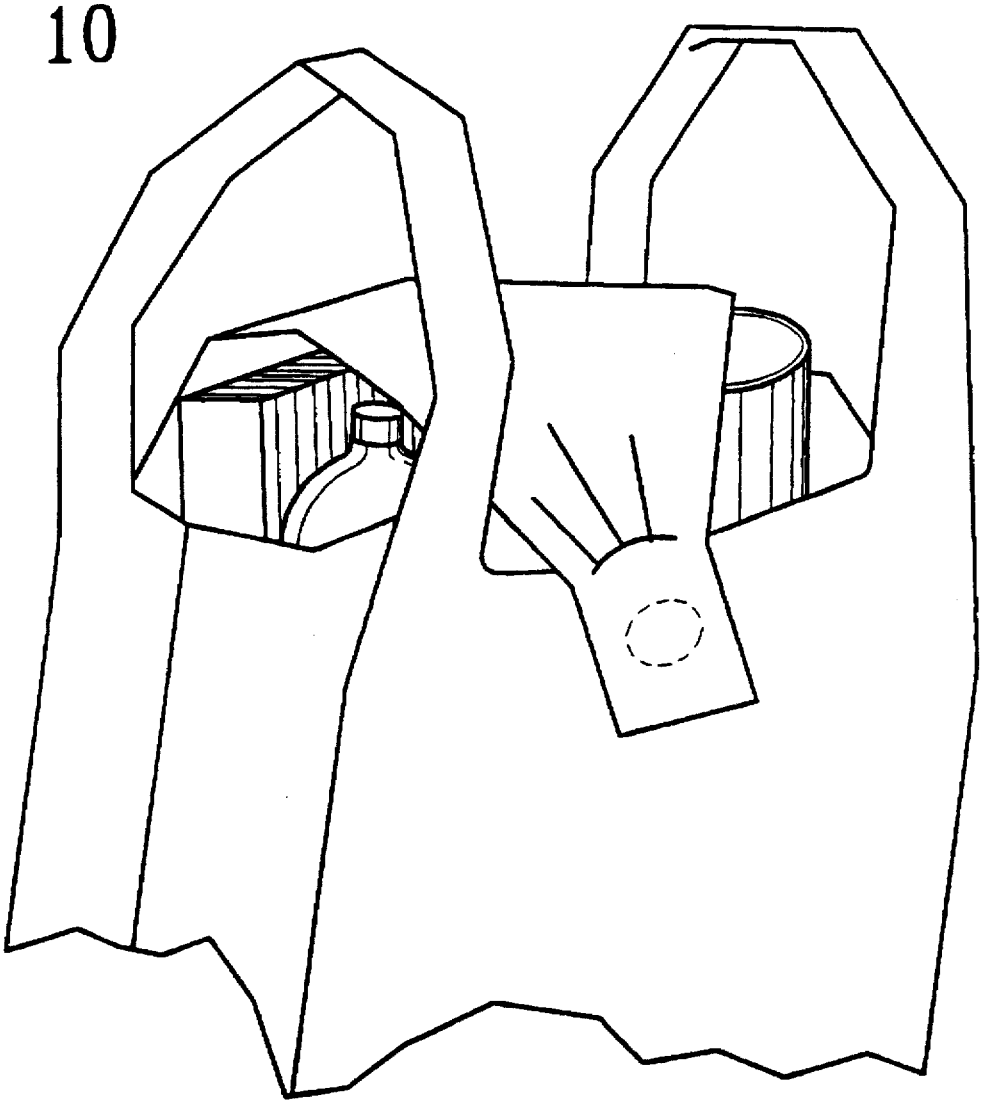
FIG. 10 is a perspective view of a closed bag utilizing the closure of the present invention.

The adhesive material used in the present invention should be any one having a low tack-high shear quality. By low tack-high shear, it is meant the adhesive has much more holding strength in a direction parallel to the wall of the bag than in a direction normal thereto. The importance of this characteristic may be seen in reference to FIGS. 5 through 7 which illustrate the operation of the closure. FIG. 5 is a section view of a bag 50 taken through the closures 50, 52 to show in side elevation a fully loaded bag ready for closure. For clarity the bag handles are not shown. The adhesive zone 22 is shown located on the bag front wall 12. The first and second closures in this embodiment are a front closure tab 50 extending upwardly from the front wall 12 and a rear closure tab 52 extending upwardly from the rear wall 14. The front closure tab 50 and the rear closure tab 52 are separated by the distance between the front wall and the rear wall. To close the bag, the user grasps the front closure tab 50 and pulls it across the open bag mouth towards the rear of the bag as shown in FIG. 6. Next, the rear closure tab 52 is grasped and pulled across the now partially closed bag mouth towards the front of the bag in cooperative relationship with the front closure tab so as to engage the adhesion zone and close off the bag mouth as shown in FIG. 7. Arrows A and B illustrate the direction of the shear forces which the adhesive must resist in order to hold the bag closed securely. The bag may be reopened by grasping the rear closure tab and pulling it upward in the direction of arrow C. The adhesive material will desirably have much less holding power in this direction so that the bag is relatively easy to reopen for unloading. The closed bag is illustrated in perspective view in FIG. 10.

Any adhesive material having the low tack-high shear properties as just described is suitable for use in the present invention. A particularly desirable material is an adhesive comprised of an amorphous polyolefin such as the Estoflex™ brand material manufactured by the Eastman Chemical Company. This material is well suited for use with goods constructed of thin thermoplastic films and is available in several grades. It may be desirable to blend different grades of this material in order to achieve the desired adhesive characteristics depending on both the size of the bag and the intended bag use. It has been found that a desirable blend of Estoflex™ brand components is as follows:

| Adhesive | % of Blend |
|---|---|
| T1035 (D-156) | 25% |
| D-117 | 50% |
| D-139 | 25% |

The T1035 component is a propylene-butene-ethylene terpolymer. Each of the components listed above has varying physical properties such as viscosity, softening point temperature, glass transition temperature and elongation percentage.

Testing of the bag closure of the present invention was conducted to quantify adhesive shear strength of the preferred adhesive blend described above. The test was conducted by placing a 1 mil thick adhesion zone comprised of a 9.53 mm (⅜ in) diameter circle of the Estoflex™ brand adhesive blend on the front wall of a test bag. The adhesive zone was centered from side to side on the bag and was positioned about 12.7 mm (½ in) below the bag mouth. The bag was closed as described herein above with the rear closure tab being brought into contact with the adhesion zone. There was about 2.54 cm (1 in) of rear closure tab material extending below the bottom of the adhesion zone. Portions of the bag front wall and back wall were then cut out of the bag to form two single ply pieces of film joined together by the adhesion zone.

An Instron test device was then utilized to measure the shear force required to separate the two pieces of plastic. The test was conducted by clamping the film sample ends into opposing jaws (one fixed, one moving) of the test device. The Instron device was set up with a 454 gram load cell, a travel speed of 51 cm/min (20 in/min), and a maximum travel distance of 5.1 cm (2 in). The moving clamping jaw was attached to the load cell, which recorded the maximum force required to fully shear apart the two pieces of plastic. The following typical test results were obtained from the adhesive samples comprised of the blend described above:

| Test Bag | Force (grams) |
|---|---|
| 1 | 229 |
| 2 | 220 |
| 3 | 218 |
| 4 | 226 |

An average shear force for the blend was found to be about 226 grams. It was also found that either too weak an adhesive or too small an amount of adhesive was inadequate to hold the closure tabs together under moderate tension. Further testing with other blends indicated that a minimum acceptable shear force was about 150 grams. Conversely, an overly aggressive adhesive caused the closure tabs to bond so strongly that the two plys of bag material could not be separated without destruction. It was determined that an adhesive bond having a shear force of 300 grams or more was unacceptable and in many cases caused extreme film deformation and tearing.

The present invention comprehends the creation of an adhesive bond between a closure and an adhesive zone that is sufficiently strong to hold a fully loaded bag closed during transport to a new location for unloading. That bond must have relatively high shear strength to resist the forces that tend to separate the closure, yet have a lower tack strength so that the two closures may be easily separated and open the bag. An overly aggressive adhesive material may have too great a tack strength and may create an adhesive bond between leading and following bags in a bag pack. While such an adhesive has been used in the prior art as a means to open a following bag, it would degrade the performance of the present invention. As will be appreciated from the discussion herein above, there exists a range of acceptable levels of shear force for the practice of the present invention. One of ordinary skill in the art may quite readily develop a satisfactory adhesive within this range for a particular use. However, a significant change in bag size, use or construction from that described herein could dictate departing from that range. It should also be recognized that it is possible to vary the holding power of the adhesive bond by varying the size of the adhesive zone and the thickness of the adhesive material therein.

Figure 8:
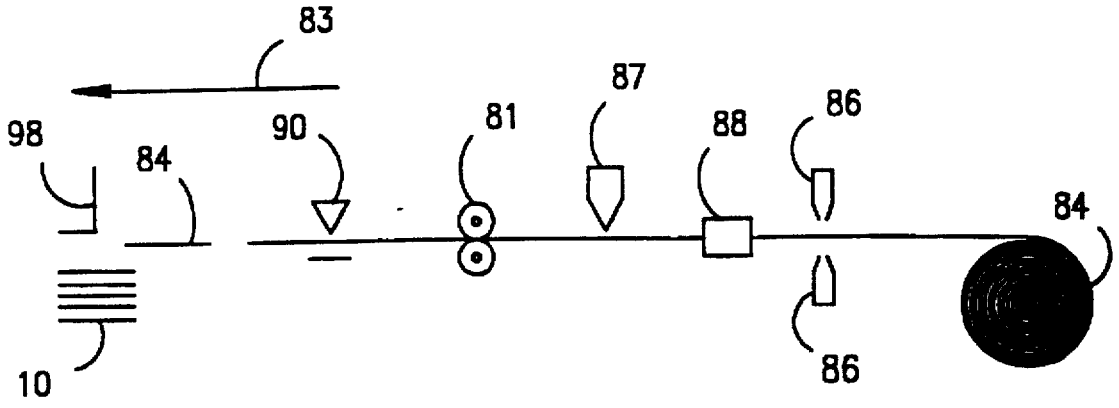
FIG. 8 is a schematic illustration of a side view of the formations of the bag pack of the present invention.
Figure 8A:
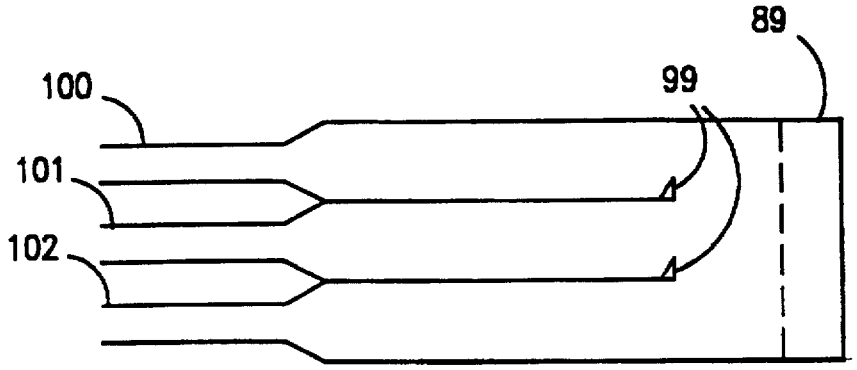
FIG. 8A is a schematic illustration of the use of a very wide tube of flattened thermoplastic material to make the bag pack of the present invention.

Turning now to FIGS. 8 and 8A, there is illustrated schematically the formation of the bag pack of the present invention. A convoluted roll 84 of a flattened tubular film is the precursor for the individual bags. Although a single roll of film is shown in FIG. 8, it is within the scope of the present invention to form bags from three flattened tubes simultaneously. This embodiment is depicted in FIG. 8A where a very wide convoluted roll 89 is fed in the machine direction 83 into two heat slit means 99 which simultaneously slit and seal the layflat tube into three tubes of equal width. The heat slit means can be a bar containing resistance heaters that hot cut and seal the film. This process is well known in the art and will not be described in more detail herein. The remaining steps in the making of the bag of the present invention should be understood to take place on either a single tube 103 supplied from a bulk roll or on three tubes 100, 101, 102 simultaneously downstream of a heat slit means.

The film material can be any thermoplastic material which can be treated with corona discharge so as to be utilizable in the bag pack of the present invention. A suitable class of materials are the polyethylenes generically, including homopolymer polyethylene of high, intermediate or low density, linear low density copolymers of ethylene and another $C_3$–$C_{10}$ alpha-olefin (LLDPE). It is also well-known to utilize blends of these materials or coextruded multilayers of these materials in the manufacture of bags. The thickness of the film is that normally used for grocery bags and may range from about 0.3 to about 1.5 mils or greater. A preferred thickness is from about 0.45 to about 0.75 mils. Any size bag is contemplated but the ⅙ barrel bag and smaller is preferred.

The film material may then be passed in the machine direction 83 for optional processing between two oppositely disposed corona discharge treaters 86 positioned so as to treat the outside surfaces of the collapsed tube in areas that will become the walls of the finished bags. The treatment can be intermittent so as to treat designated region or regions of the film. Corona discharge treatment equipment is readily available commercially. Appropriate equipment can be obtained from Solo Systems Inc., Garland, Tex.; Corotec Corp., Collinsville, Conn.; and others. It should be understood that while corona discharge treatment is a desirable step in the manufacture of any thermoplastic bag, such treatment is not a required step in the manufacture of the present invention.

The practice of the present invention comprehends a particular selectivity with respect to any corona discharge treatment of the exterior surface of the bag rear wall 14. At least a portion of that surface must be left free of corona discharge treatment. More particularly, the portion of the rear wall exterior surface of a leading bag that is in substantial alignment with the adhesion zone located on the front wall exterior surface of a following bag should be untreated. This intentional alignment of untreated surface to adhesion zone is intended to inhibit incidental adhesion between bags and the loss of adhesive material from the front walls of the bags.

After optional corona discharge treatment the tube is passed to a gusseter 88. There the tube is inflated and drawn over forming blades which extend transversely into the tube to create side gussets of from about 3 to about 5 inches therein. After gusseting the adhesive zone 22 is formed at 87. It may be desirable to stop the travel of the film tube momentarily to permit exact placement of the adhesion zone 22 on the film. The stop/go motion ensures precise registration of the adhesive material relative to the remainder of the bag. A suitable mechanism for the practice of this invention is a Nordson Model 3024 hot melt applicator.

Figure 9:
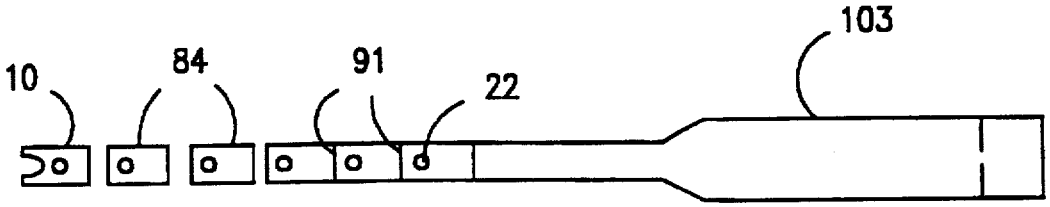
FIG. 9 is a schematic illustration of a top view of the formation of the bag pack of the present invention.

After formation of the adhesive zone 22, the tube is drawn by roller 81 to a transverse heat seal means 90 of conventional design which imposes heat seals 91 (See also FIG. 9) at bag length distances apart. Such a heat seal means is usually a resistance strip or bar which not only places a transverse seal across the gusseted tube but also severs the tube near the point of the seal to form end-sealed gusseted pillowcases 84. The pillowcases are then stacked to the appropriate number desired, e.g., 50, 75, 100, 125, etc., and, either in line or at a remote location, a cutting device 98 applies pressure and cuts one end of the stack so as to remove plastic, leaving the shape of handles, a bag mouth and front and rear closure tabs in the bag pack. This cutting device 98 may also include means for including a suspension orifice in the handles of the bags. The orifice can be of a variety of shapes, e.g., a circle, part of a circle with a flap remaining therein, a curve of less than one-quarter of a circle, a straight slit, a teardrop cutout, a zig-zag orifice, etc.

At this point in the manufacturing process, it may be desirable to create localized pressure areas in the stack of bags in order to create an easy opening feature. A desirable process for doing so is disclosed in the Boyd and Smith patents discussed herein above. Utilization of those processes may require corona discharge treatment in exterior surfaces in addition to those just described. However, the practice of those processes is compatible with the requirement of the present invention that at least a portion of the bag rear wall be free of treatment.

An adhesive closure provides advantages over those disclosed in the prior art. This closure provides a very easy to use means to quickly close off the open mouth of a grocery bag. The closure may then be opened easily for unloading without destroying the bag.

It is also possible to color tint the adhesive material so that the end user may very quickly locate the adhesive zone 22 on the bag front wall. A contrasting color causes the adhesive zone 22 to stand out from the remainder of the bag wall. In a busy grocery store operation, the few seconds saved by this feature add up to significant cost savings when multiplied by hundreds of transactions per day.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims and their equivalents.

What is claimed is:

1. A pack of thermoplastic bags, the bags being in at least approximate registration, each bag comprising:

(a) a front wall having an exterior surface;

(b) an adhesion zone located on the exterior surface of the front wall;

(c) a rear wall having an exterior surface, wherein at least a portion of the rear wall exterior surface is free of corona discharge treatment, the portion being in substantial alignment with the adhesion zone of a following bag in the pack;

(d) gusseted side walls connecting the front and rear walls;

(e) an open bag mouth defined by the front wall, rear wall and side walls; and (f) a first closure integral with the front wall and positioned at the bag open mouth and a second closure integral with the rear wall and positioned at the bag open mouth, whereby the first closure and the second closure are adapted to close the open bag mouth by the engagement of the second closure with the adhesive zone.

2. A bag pack according to claim 1 wherein the adhesive zone is located just below the first closure.

3. A bag pack according to claim 1 wherein the first closure and the second closure are tabs.

4. A bag pack according to claim 3 wherein the tabs are fused together at an upper end thereof such that sufficient tab height is presented to permit the second closure to engage the adhesion zone.

5. A bag pack according to claim 2 wherein the adhesion zone is comprised of a low tack-high shear adhesive.

6. A bag pack according to claim 5 wherein the low tack-high shear adhesive has a shear adhesion strength of from about 150 grams to less than 300 grams.

7. A bag pack according to claim 1 wherein the adhesive zone is color tinted.

8. A bag pack according to claim 1 further comprising at least one additional closure in the front wall and at least one additional closure in the rear wall;

wherein the additional rear wall closure is adapted to engage a corresponding adhesion zone located on the front wall.

9. In a bag pack comprising a stacked series of handled flexible thermoplastic bags, each having front and back walls, each of the front and back walls having exterior surfaces and a mouth portion disposed between lateral handles, the improvement which comprises:

a front closure tab disposed at the bag mouth and extending outwardly from the front wall;

an adhesive material having low tack and high shear strength properties overlying at least a portion of the exterior surface of the front wall; and a rear closure tab disposed at the bag mouth opposite the front closure tab extending outwardly from the rear wall and adapted for cooperation with the front closure tab during closure, wherein the rear wall exterior surface is substantially free of corona treatment in a zone opposite the adhesive material of a following bag to minimize incidental adhesive contact between adjacent serial bags in the stacks.

10. The bag pack of claim 9 wherein the adhesive material has a shear adhesion strength of from about 150 grams to less than 300 grams.

11. The bag pack of claim 10 wherein the adhesive zone is color tinted.

12. A bag pack of claim 11 further comprising at least one additional rear closure tab and at least one additional front closure tab, the one additional rear closure tab having corresponding adhesive material located on the exterior surface of the front wall.

* * * * *